United States Patent [19]

Adachi et al.

[11] 4,421,477

[45] Dec. 20, 1983

[54] COMBUSTION WICK

[75] Inventors: Kinichi Adachi, Takarazuka; Hisanori Shimoda, Neyagawa; Yasushi Hirata, Nara; Yoshimi Ohmukai, Hirakata, all of Japan

[73] Assignee: Matsushita Electric Industrial Co., Ltd., Osaka, Japan

[21] Appl. No.: 366,168

[22] Filed: Apr. 7, 1982

[30] Foreign Application Priority Data

| | | | |
|---|---|---|---|
| Apr. 13, 1981 | [JP] | Japan | 56-56072 |
| May 14, 1981 | [JP] | Japan | 56-73057 |
| Aug. 19, 1981 | [JP] | Japan | 56-129950 |
| Aug. 20, 1981 | [JP] | Japan | 56-131150 |
| Oct. 26, 1981 | [JP] | Japan | 56-170909 |
| Nov. 4, 1981 | [JP] | Japan | 56-176872 |
| Nov. 9, 1981 | [JP] | Japan | 56-179454 |

[51] Int. Cl.[3] ..... F23D 3/18

[52] U.S. Cl. ..... 431/325; 502/400

[58] Field of Search ..... 431/325, 298, 326, 327, 431/201, 200; 239/145; 126/96; 252/425.5; 428/375, 392, 396, 407

[56] References Cited

U.S. PATENT DOCUMENTS

| | | | |
|---|---|---|---|
| 2,210,290 | 8/1940 | Heinsohn | 431/325 X |
| 3,162,030 | 12/1964 | Irving | 431/325 X |
| 3,367,318 | 2/1968 | Murakami et al. | 431/325 X |

FOREIGN PATENT DOCUMENTS

| | | | |
|---|---|---|---|
| 55-3524 | 1/1980 | Japan | 431/325 |
| 55-3527 | 1/1980 | Japan | 431/325 |

*Primary Examiner*—Samuel Scott
*Assistant Examiner*—Randall L. Green
*Attorney, Agent, or Firm*—Stevens, Davis, Miller & Mosher

[57] ABSTRACT

A combustion wick comprising a fuel suck-up portion wherein liquid fuel is sucked up and a fuel gasifying portion provided above said fuel suck-up portion is provided wherein of said fuel suck-up and fuel gasifying portions, at least the fuel gasifying portion is formed from silica-alumina type ceramic fibers with an organic binder, with at least a part of said portion being impregnated with a coating material composed principally of an inorganic pigment, silicic anhydride and a surface active agent. By impregnating at least part of the fuel gasifying portion with the coating material, no or little tar-like substance is formed or deposited on the fuel gasifying portion.

7 Claims, 5 Drawing Figures

COMBUSTION WICK

FIELD OF THE INVENTION

The present invention provides a combustion wick which is capable of long-time stabilized gasification of liquid fuel from the fuel gasifying portion by minimizing generation and accumulation of tar-like substance at the fuel gasifying portion of the wick, thereby allowing maintenance of stabilized combustion at the combustion portion where the gasified fuel is burned.

BACKGROUND OF THE INVENTION

The so-called fuel sucking-up and gasifying type combustors, in which, for example, liquid fuel in the fuel tank is sucked or drawn up by the capillary action of the combustion wick and gasified and burned at the surface of the fuel gasifying portion at the upper end of the wick projecting into the gasifying chamber in the combustion section of the combustor, are popularly used for the kerosene heater, oil burners and the like. In this type of combustors, since the fuel gasifying portion of the wick is located in the gasifying chamber which is heated to a high temperature and in which oxygen is also allowed to exist, there inevitably occurs the phenomenon that a part of the liquid fuel soaked in the fuel gasifying portion of the wick is turned into a tar-like substance by dint of oxidation, polymerization reaction and/or other chemical actions during combustion and such tar-like substance deposits on the fuel gasifying portion of the wick. Formation and deposition of such tar-like substance are noticeably promoted in case small amounts of high-boiling materials are mixed in the liquid fuel (for example, in case machine oil, gas oil, salad oil or such is mixed in kerosene) or in case the liquid fuel components are partly denatured (for example, in case an doxide, peroxide, resin or such is produced in kerosene as a result of long-time exposure to a high temperature or to direct rays of the sun). Accumulation of such tar-like substance on the fuel gasifying portion of the wick causes blocking of the capillaries in the surface or the inside of said gasifying portion to impair suction or gasification of the liquid fuel, resulting in various troubles or inconveniences such as an abnormal reduction of the liquid fuel gasification rate or fluctuation of the air/fuel ratio in the combustion chamber to produce an offensive smell, soot and harmful substances such as carbon monoxide in great volumes. Also, at the time of ignition, said tar-like substance obstructs quick rise of temperature of the fuel gasifying portion or increase of the fuel gasifying rate, thus necessitating a very long time till reaching a stable combustion, and during this time, there would be generated an offensive smell, soot, carbon monoxide, etc., in volumes due to unstable over-combustion. Combustion wick is usually supported on its both sides by a draft pipe and designed such that, when igniting the wick, it is raised above said draft pipe and, when putting out fire, said wick is lowered down, but if said tar-like substance builds up on the wick, it might adhere to the draft pipe to make it unable to put out fire even if the wick is lowered, bringing about a very dangerous situation.

The present invention is to deal with the technical subject for minimizing or discouraging formation and deposition of said tar-like substance on the gasifying portion of the wick, and as a solution to such problem, the invention provides a novel structure for the fuel gasifying portion of the wick which is described in detail hereinbelow.

SUMMARY OF THE INVENTION

According to this invention, silica-alumina type ceramic fibers are molded into a desired form with an organic binder and at least a part of the molding is impregnated with a coating material composed principally of an inorganic pigment, silicic anhydride and a surface active agent to thereby constitute the fuel gasifying portion of the wick.

Now, the present invention is described in detail by way of an embodiment thereof with reference to the accompanying drawings.

Figure 1:
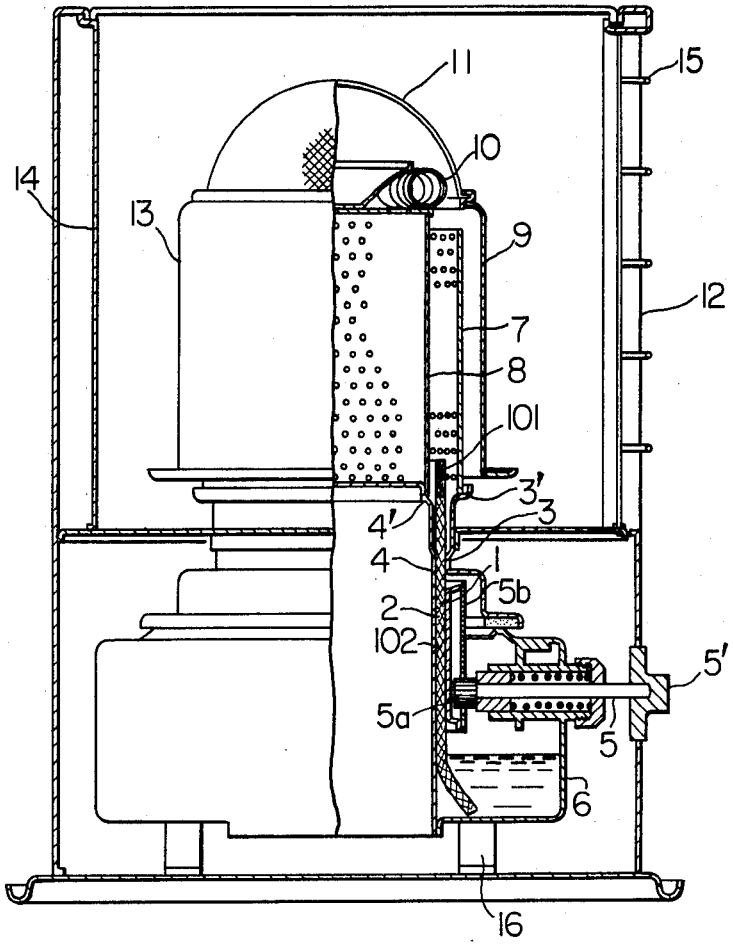
FIG. 1 is a sectional view of a combustor adapted with a wick according to an embodiment of the present invention.

FIG. 1 shows a sectional view of a combustor incorporating a combustion wick in accordance with an embodiment of this invention. In the drawing, numeral 1 designates a cylindrical wick capable of drawing up liquid fuel, said wick consisting of an upper fuel gasifying portion 101 composed of silica-alumina fibers and a lower fuel sucking-up portion 102. The "fuel gasifying portion" 101 as referred to herein means that portion of the wick which stays protuberant into the chimney 13 from between the outside fire plate 3' and the inside fire plate 4' when the wick is aflame.

Numeral 2 refers to a cylindrical wick supporter which is secured to the inside of said fuel sucking-up portion 102, with the interior surface of said wick supporter 2 being in contact with the corresponding exterior surface of a cylindrical draft pipe 4. Said draft pipe 4 terminates into the inside fire plate 4' at its top end. Numeral 3 denotes a cylindrical wick guide unit which terminates into the outside fire plate 3' at its top end. 5 indicates a wick control unit having a knob 5' designed such that when the user turns said knob 5', the wick 1 is moved vertically through movement of a pinion **5*a* along a rack 5*b* secured to the wick 1. 6 is an oil tank which is square in planar configuration. 13 refers to a chimney consisting of a cylindrical radiation net 7 having a plurality of air holes, a cylindrical inside-tube 8 also having a plurality of air holes, a cylindrical chimney support 9, a ring-shaped coil 10 and a half-spherical net 11. Also in the drawing, numeral 12 indicates a cabinet, 14 a reflection plate provided on the side opposite from the opening (front side) of the combustor, 15 a safety guard, and 16 the legs of the oil tank 6**.

Figure 2:
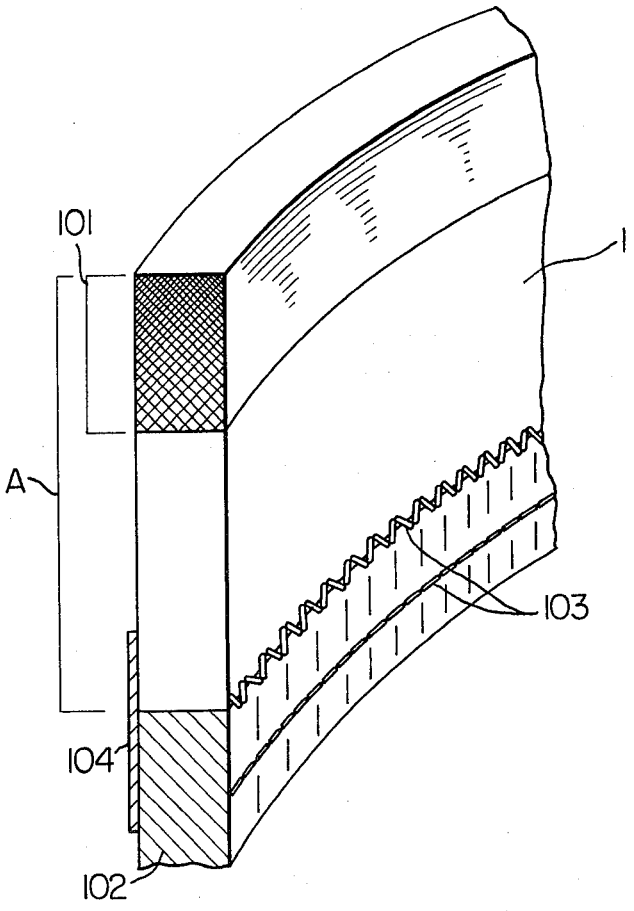
FIG. 2 is a perspective view of the principal parts of said wick.

Referring to FIG. 2, there is shown a part of the wick 1 of which the upper portion A is composed of silica-alumina ceramic fibers (silica:alumina$\approx$50:50) molded into a suitable configuration, specifically into a plate, with a small quantity of an organic binder, said plate being further worked into a cylindrical form. The fuel sucking-up portion 102 is composed of a polypropylene cloth or cotton and jointed to the upper portion A. The fuel gasifying portion 101 is impregnated in its entirety with a coating material composed principally of silicic anhydride, an inorganic pigment and a surface active agent. The pickup of said coating material is gradually lessened from the upper end of the gasifying portion 101 toward its lower end. In FIG. 2, numeral 103 refers to sewing yarn and 104 an adhesive tape. In this embodiment, the wick 1 is constituted by joining the fuel gasifying portion 101 and the fuel sucking-up portion 102 by sewing yarn 103, but said both portions may be simply connected to each other without sewing, that is, said both portions may be formed as separate members and joined detachably from each other, and hence the adhesive tape 104 is not always required. In the above-described wick structure, the liquid fuel in the tank 6 is sucked up through the fuel sucking-up portion 102 into the fuel gasifying portion 101 and is gasified from the surface of said fuel gasifying portion 101. During this stage, since the fuel gasifying portion 101 of the wick is positioned in the chimney 13 as shown in FIG. 1, the liquid fuel is exposed to a high-temperature atmosphere till it is gasified although such period is very short. Resultantly, the liquid fuel components are partly oxidized under the influence of high temperature and oxygen in the air to form a tar-like substance which, when accumulated, blocks the pores in the fuel sucking-up portion 102 and gasifying portion 101 to cause a reduction of the fuel gasifying rate. Particularly in case of using kerosene which has been partly denatured (oxidized) after long-time storage or which is rich with heavy components, formation of tar or tarry substance is promoted to invite a rapid decrease of the fuel gasifying rate.

The "tar-like substance", which is responsible for the gradual reduction of the fuel gasifying rate, is a substance that is formed as the component materials of kerosene are polycondensed to substantially lose their fluidity, and if such substance builds up on the inside of the wick 1, its fuel sucking-up capacity is deteriorated, resulting in a decreased fuel gasifying rate. When such substance is formed on the surface of the fuel gasifying portion 101, the fuel gasifying rate is temporarily lowered as the pores in said gasifying portion 101 are blocked by said substance, but since the temperature at this portion is elevated because of the reduced gasification rate, said tar-like substance is decomposed or oxidized by such high temperature to restore the original fuel gasifying rate. Therefore, in the wick gasification type of combustors, it is a key factor for bettering the fuel gasifying characteristics not to allow accumulation of the tar-like substance on the inside of the wick.

Generally, in the wick gasification systems employing the principle of capillarity, there is adopted a structure in which the fuel gasifying portion of the wick is located close to the oil level in the oil tank to elevate the pressure of the liquid fuel in the capillaries so that the fuel components which have begun to turn into tar are forced up to the fuel gasifying portion 101 by said elevated pressure, thereby discouraging solidification of the tar-like substance in the inside of the wick. In this case, however, there arises a problem on safety when the fuel gasifying portion 101 is positioned too close to the fuel level. It is also proposed to use a material with small pores to reduce the capillary bores to thereby elevate the internal pressure to attenuate the tendency of the tar-like substance to accumulate in the inside of the wick. Currently, as the fuel sucking-up and gasifying type of wicks, there are popularly used those which are basically composed of glass fiber in consideration of heat resistance and workability. When this fiber is used, the average pore size in the wick is approximately 40$\mu$. This pore size is too large to discourage accumulation of the tar-like substance in the inside of the wick. For example, in case kerosene mixed with about 0.1% of salad oil is used as liquid fuel and is gasified and burned through the wick, the fuel gasifying rate is sharply reduced in about 3 to 5 hours, with the combustion rate being lowered by 20% from the initial level, and if combustion is further continued for about 10 hours, the combustion rate drops by about 50% and the wick can no longer perform its due function. The state of the wick in this situation is such that the fuel gasifying portion at the end thereof burns off as little oil comes up thereto, and a layer of tar clings to the inside of the wick along its length of about 6 to 10 mm from the top end thereof.

There are lately marketed the wicks using a material with smaller pore size than glass fiber. The material used for such wicks is ceramic fiber, and the wicks are produced from this material by using a small quantity of an organic binder according to a paper-making method. Such ceramic fiber is paper-like and flexible, and hence it is easy to work and has substantially equal workability to glass fiber. This material has capillary bores of 1–50$\mu$ (5–10$\mu$ on the average) in diameter, so that the wick made therefrom has smaller pore size than the glass fiber-made one and hence is less prone to accumulation of tar-like substance on the inside. However, the wick made by merely bonding said ceramic fibers with a few percent of an organic binder has the drawback that the organic binder is gradually decomposed in use due to burning-off and/or other causes and thus loses its binding strength to make the wick unable to stand further use.

The present invention aims at enhancing the fiber binding strength while improving the tar keeping-off characteristics of the wick to minimize reduction of its fuel gasifying rate by impregnating the ceramic fiber-made fuel gasifying portion of the wick with a coating material which is principally composed of an inorganic pigment, silicic anhydride and a surface active agent. More specifically, according to this invention, a heat-resistant inorganic pigment is incorporated at least at a part of the fuel gasifying portion 101 including its upper end so as to lessen the capillary bores in said portion to thereby better the anti-tar characteristics of the wick by dint of said principle. It is however expedient to adopt a structure in which other portions of the wick than the fuel gasifying portion, that is, the portions not heated to a temperature above 100° C. during combustion have in some measure large capillary bores to allow a high oil pickup. This is for the reason that below 100° C. the liquid fuel components are scarcely turned into tar and hence no influence is given even if the liquid fuel stays for a long time in said portions. Rather, presence of a greater amount of liquid fuel in said portions allows a faster supply of fuel to the fuel gasifying portion 101 and hence more effective prevention of tar formation. Therefore, even in the upper section A in the illustration of FIG. 2, it is desirable that the part other than the fuel gasifying portion 101 is not impregated with said coating material, and further, in the fuel gasifying portion 101 itself, it is expedient that the surface thereof (where the fuel is actually gasified) is impregated to a greater degree than the inside thereof.

As for the heat-resistant inorganic pigment used as the principal component of said coating material, it is possible to employ any suitable type of inorganic pigment which is capable of resisting heat of up to 600°–700° C. The ingredients thereof are not subject to any specific restrictions, but it is desirable that the particle size thereof is of the order of 1 to 30μ, which is slightly smaller than the capillary bores in the fuel gasifying portion 101. A binder is required for incorporating said coating material in the fuel gasifying portion 101. Such binder is preferably of the type which is resistant to heat, has good adhesiveness to the base of the fuel gasifying portion 101 and also has no possibility of impairing porosity of the wick.

Now, the effect of the coating material and wick according to this invention is described in detail by way of the preferred embodiments thereof.

First, the combustor, liquid fuel and other matters applied in the present embodiments of the invention are described.

Used as the combustor was a commercially available wick gasification type fan heater. This combustor is of the type which is capable of adjusting air feed by an ejector system, and the maximum wick length above the oil level (distance from the oil level in the tank to the fire plate) is 90 mm. Used as liquid fuel were kerosene mixed with 0.1% of salad oil (produced by Nisshin Oil Co., Ltd.) and kerosene (acid value: 0.1) which was kept outdoors in a white polyethylene container for one month. There were used the following two types of wick: a glass fiber wick of the type commonly used in the portable oilstoves (said glass fiber wick being remodeled to 90 mm maximum length above the oil level) and a wick according to this invention shown in FIG. 2 in which the section A is composed of a flexible ceramic fiber plate (thickness: 3 mm, density: 0.33 g/cm$^3$, produced by Nippon Asbestos Co., Ltd.). As for the constituents of the coating material, colloidal silica (Snowtex C available from Nissan Chemical) was used as silicic anhydride, OKITSUMO IP-1000 BL (Mie Oil) as inorganic pigment and Emulgen-909 (Kao Soap) as surface active agent.

The results are shown in Table 1.

As seen from the above table, in case the fuel gasifying portion was formed from glass wick and 0.1% salad oil mixed kerosene was used as fuel, the fuel gasifying rate decreased rapidly due to formation and deposition of tar-like substance, that is, the fuel gasifying rate downed 20% in 3.5 hours and 30% in only 6 hours, and at the time of 30% down, the fore end of the fuel gasifying portion was in a state akin to burning-off and tar was seen clinging to the inside of said gasifying portion along a length of about 7 mm from the top end thereof. In case denatured oil was used as fuel, the situation was not much different from the case where 0.1% salad oil mixed kerosene was used although a slight difference due to time was noted. In case the fuel gasifying portion was formed from ceramic fiber, drop of the fuel gasifying rate was slightly retarded as compared with the glass wick, but still in this case, as the time of 30% down of calorie, tar was seen depositing on the inside of the wick along a length of about 7 mm from the end and the upper end of the wick was burning off. The wick strength was also low. In the case of the wick to which a colloidal treatment was given at the end portion, there was seen almost no difference from the non-treated wick in the degree of lowering of combustion rate and the area where the tar-like substance was formed and deposited, but since the end portion was impregnated with colloidal silica, this wick presented no problem in its strength even though the end portion burned off. In the case of the wick which has been subjected to a treatment with both pigment and colloidal silica at the end portion, when it was burned continuously with 0.1% salad oil mixed kerosene, it showed 10% down of calorie in only 2.5 hours and 20% down in 5.5 hours, but it took 50 hours to mark 30% down. Observation of the condition of the wick at the time of 30% down showed that the inside of the wick was almost free of

TABLE 1

| Example | Wick specifications | Type of oil used | Results of continuous combustion: Time till 10% cal. down (hr) | Time till 20% cal. down (hr) | Time till 30% cal. down (hr) |
|---|---|---|---|---|---|
| Conventional product | | | | | |
| 1 | Fuel gasifying portion (glass wick) | 0.1% salad oil mixed kerosene | 2.5 | 3.5 | 6 |
| 2 | Fuel gasifying portion (glass wick) | Denatured oil AV = 0.1 | 4.0 | 6.5 | 10 |
| Referential product | | | | | |
| 1 | Fuel gasifying portion (ceramic paper, non-treated) | 0.1% salad oil mixed kerosene | 5 | 8 | 25 |
| 2 | Fuel gasifying portion (ceramic paper, non-treated) | Denatured oil AV = 0.1 | 8 | 20 | 40 |
| 3 | Fuel gasifying portion (ceramic paper treated with colloidal silica alone) | 0.1% salad oil mixed kerosene | 6 | 10 | 28 |
| 4 | Fuel gasifying portion (ceramic paper treated with colloidal silica alone) | Denatured oil AV = 0.1 | 9 | 25 | 45 |
| 5 | Fuel gasifying portion (ceramic paper treated with colloidal silica and pigment (no surface active agent)) | 0.1% salad oil mixed kerosene | 2.5 | 5.5 | 50 |
| 6 | Fuel gasifying portion (ceramic paper treated with colloidal silica and pigment (no surface active agent)) | Denatured oil AV = 0.1 | 4 | 8 | 80 |
| Example 1 of this invention | Fuel gasifying portion (ceramic paper treated with colloidal silica, pigment and surfactant | 0.1% salad oil mixed kerosene | 30 | 85 | over 150 |
| Example 2 of this invention | Fuel gasifying portion (ceramic paper treated with colloidal silica, pigment and surfactant | Denatured oil AV = 0.1 | 75 | over 150 | over 150 |

tar-like substance and only a small deposition of tar-like substance was formed near the surface of the fuel gasifying portion. In case no surface active agent is used, the pigment does not penetrate deep into the inside and hence the fuel gasifying portion is densified in its surface but not in the inside. Therefore, if tar is accumulated slightly on the densified surface of the fuel gasifying portion, drawing-up of fuel to the gasifying surface is obstructed to greatly lower the combustion rate in the early period, but since tar is not accumulated on the inside, lowering of the fuel gasifying rate (combustion rate) thenceforth slows down. In the case of the wicks in which a coating material consisting of a pigment, silicic anhydride and a surface active agent has been impregnated into the fuel gasifying portion as in the Example products of this invention, when 0.1% salad oil mixed kerosene was used as fuel, 30 hours were required till reaching 10% down of combustion rate and 85 hours for reaching 20% down, which indicates the very excellent quality of these wicks in comparison with the non-treated ones. Also, after 150-hour continuous burning, almost no accumulation of tar-like substance was seen on the inside and also the wick strength remained quite satisfactory.

Then, there were prepared the wicks 1 same as shown in FIG. 2 and a coating material of the composition shown below, and by impregnating said wicks with said coating material to various degrees of impregnation by diluting said composition with water, they were subjected to a continuous combustion test with the combustor employed in Example 1 by using 0.1% salad oil mixed kerosene as fuel. The results are graphically shown in FIG. 3. The coating material was impregnated to the length of 15 mm from the top end of the fuel gasifying portion downwardly in all specimens.

Coating Material Composition

Figure 3:
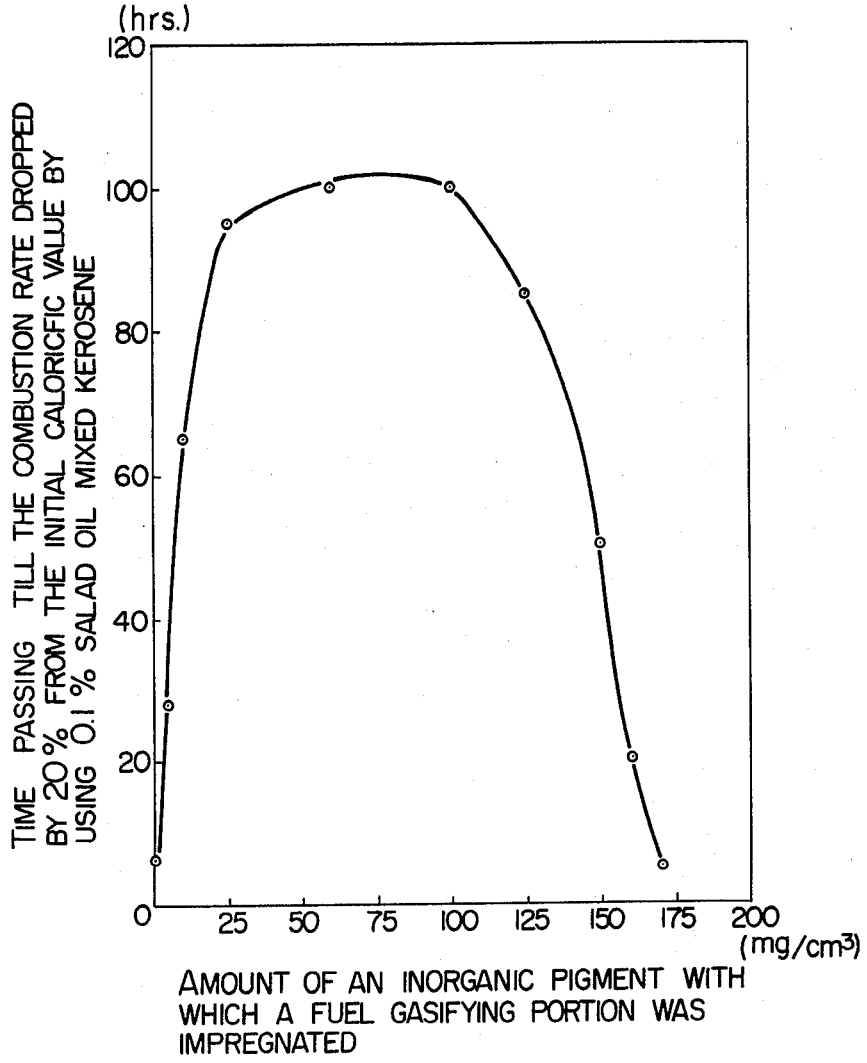
FIGS. 3 to 5 are the characteristic diagrams of the wick.

Solution prepared by dispersing a black pigment (composed principally of iron oxide and manganese oxide) in water at a ratio of 60% by weight to water: 100 parts by weight 20 wt% colloidal silica solution (Snowtex E produced by Nissan Chemical): 300 parts by weight Surface active agent (Emulgen 909 produced by Kao-Atlas): 10 parts by weight Water: arbitrary In the graph of FIG. 3, the amount (mg/cm$^3$) of the inorganic pigment per unit volume of the fuel gasifying portion 101 is plotted as abscissa and the time that passed till the combustion rate dropped 20% from the initial calorific value in continuous combustion by using 0.1% salad oil mixed kerosene is plotted as ordinate. As noted from the graph, the time till reaching 20% down of calorific value is 20–25 hours when the impregnated amount (pickup) of the inorganic pigment is less than 10 g/cm$^2$ but said time is prolonged to 65 hours when the pickup of the inorganic pigment is 15 g/cm$^3$, and said time is again shortened sharply when said pickup exceeds 160 g/cm$^3$. This indicates that too much pickup of inorganic pigment causes blocking of the pores in the fuel gasifying portion 101, resulting in a multiplied influence by only a slight accumulation of tar-like substance.

Then, there were again prepared the wicks 1 same as shown in FIG. 2, and the fuel gasifying portion 101 of each of these wicks was impregnated with a coating material of the composition shown below. The condition of impregnation in the fuel gasifying portion 101 was varied by changing the immersion time for impregnation, and these wicks were subjected to the same continuous combustion test as described above. The results are given in Table 2.

Coating Material Composition

Solution prepared by dispersing a black pigment (composed principally of iron oxide and manganese oxide) in water in a ratio of 60% by weight to water: 100 parts by weight 20 wt% colloidal silica solution (Snowtex-C produced by Nissan Chemical): 300 parts by weight Surface active agent (Emulgen-909 produced by Kao-Atlas): 10 parts by weight Water: 600 parts by weight

TABLE 2

| Example | Immersion time (sec) | Optical density A | | Life characteristics B | |
|---|---|---|---|---|---|
| | | Surface | Inside | Time till 20% down (hr) | Time till 30% down (hr) |
| 3 | 1.0 | 0.93 | 0.51 | 40.0 | 100.0 |
| 4 | 3.0 | 0.91 | 0.55 | 95.0 | 172.0 |
| 5 | 5.0 | 0.85 | 0.60 | 88.0 | 168.8 |
| 6 | 10.0 | 0.79 | 0.68 | 48.0 | 110.0 |

(Notes)
A:Optical density of the surface and the inside of the fuel gasifying portion 101. It is proportional to the content of the coating material.
B:Time of continuous combustion by using 0.1% salad oil mixed kerosene as fuel. "20% down" means that the combustion rate dropped to 80% of the initial level and "30% down" means that the combustion rate dropped to 70% of the initial level.

As apparent from Table 2, the wick of Example 4 has the best life characteristic, and such characteristic is deteriorated in the wick of Example 5 and further deteriorated in the wock of Example 6. This attests to the fact that the greater is the difference in coating material content between the surface and inside of the fuel gasifying portion (that is, the difference in optical density), the better result is obtained. As far as the life characteristic is concerned, the wick of Example 3 is not much different from the wick of Example 4, and thus it may be understood that basically a greater difference in coating material content between the surface and inside of the fuel gasifying portion 101 leads to a better result. It was found however that the wick of Example 3 is not suited for practical use in respect of its mechanical strength because of, for example, shrinkage of the fuel gasifying portion at the time of burning-off or cleaning.

Figure 4:
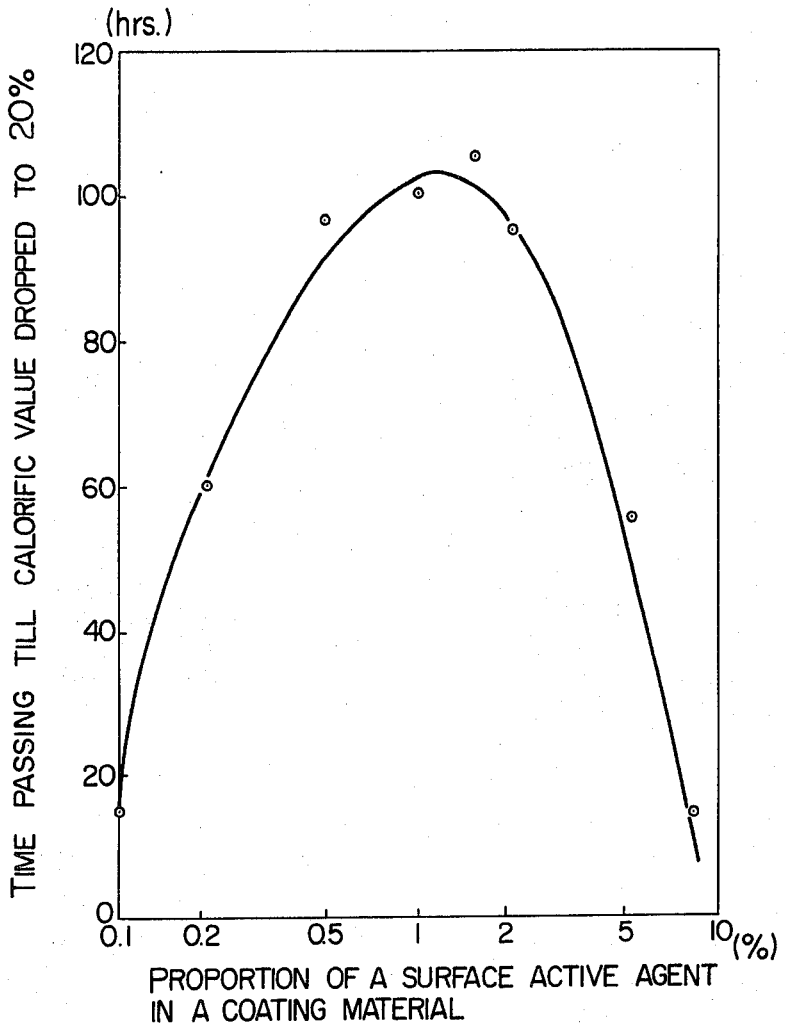

FIG. 4 shows the results of the similar continuous combustion test conducted on the wicks 1 same as shown in FIG. 2, said wicks being impregnated with a coating material of the following composition:

Solution preparted by dispersing a black pigment (composed principally of iron oxide and manganese oxide) in water in a ratio of 60% by weight to water: 100 parts by weight 20 wt% colloidal silica solution: 300 parts by weight Water: 600 parts by weight A surface active agent (Emulgen-909, Kao-Atlas) was added in an amount of 0–10% by weight based on the whole amount of the coating material.

As seen from FIG. 4, if the ratio of the surface active agent (to the whole coating material) is less than 0.1%, the initial calorific value decreases and the combustion rate is also lowered because the pigment is accumulated in the surface along to too much reduce the pore openings in the surface. When the ratio of the surface active agent is around 0.5–2%, the 20% down time is maximized. However, when said ratio exceeds 5%, since the viscosity of the solution itself increases and the solution penetrates deep into the inside of the fuel gasifying portion 101 to reduce the pore openings in said gasifying portion 101, the fuel feed rate to the gasifying surface is lowered by only a small deposition of tar-like substance to cause deterioration of combustion efficiency. It was also observed that too much content of the surface active agent is undesirable as such surface active agent itself may turn out a cause of tar formation.

The relation between particle size of the pigment and drop of combustion rate was examined by changing the particle size of the pigment. The wicks used for this examination were of the structure shown in FIG. 2.

First, there were prepared the wicks whose upper section A has been formed from alumina-silica ceramic fibers (capillary bore in the fuel gasifying portion 101 being 20–30μ in diameter), and the fuel gasifying portion 101 of each wick was impregnated with a coating material of the following composition:

Solution prepared by dispersing a black pigment (composed principally of iron oxide and manganese oxide) in water in a ratio of 60% by weight to water: 100 parts by weight 20 wt% colloidal silica solution (Snowtex-C of Nissan Chemical): 300 parts by weight Surface active agent (Emulgen-909 of Kao-Atlas): 10 parts by weight Water: 600 parts by weight Said black pigment was used by classifying it into several groups according to the particle size that ranged from 0.1 to 100μ. The pore sizes of the thus formed porous structures were measured by a mercury force-in method, obtaining the results shown in Table 3.

TABLE 3

| | Pigment classification (μ) | Average bore diameter of capillaries in fuel gasifying portion (μ) |
|---|---|---|
| A | below 0.5 | 0.2 |
| B | 0.5–1.0 | 0.5 |
| C | 1.0–1.5 | 1.0 |
| D | 1.5–5.0 | 1.5 |
| E | 5.0–9.0 | 6.5 |
| F | 9.0–12.0 | 10.0 |
| G | 12.0–20 | 12.0 |
| H | 20–50 | 23.0 |
| I | above 50 | 60.0 |

Figure 5:
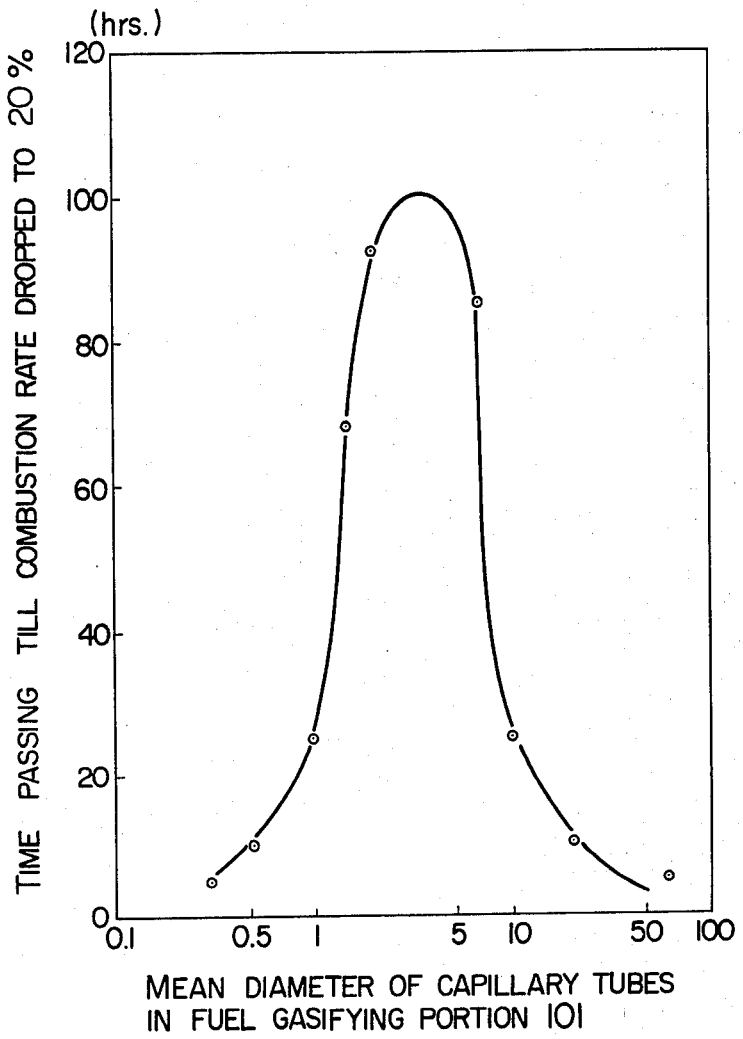

Each of the thus prepared wicks was set in a portable oil-stove and burned continuously by using kerosene mixed with 0.1% of salad oil. The results are shown in FIG. 5. When a wick not impregnated with said coating material was tested similarly, the calorific value of combustion dropped to 80% of the initial value in about 10 hours (this is hereinafter referred to as 20% calorie down time). As seen from FIG. 5, in case the average bore diameter of the capillaries in the fuel gasifying portion 101 is about same as that of the non-coating-material-impregnated gasifying portion, the 20% calorie down time is also almost same, but when said average bore diameter is of the order of 1 to 10μ, said 20% calorie down time is prolonged to around 80 hours, which indicates about 8 times as long life of the coating-material-impregnated wick as that of the non-impregnated wick. Also, almost no accumulation of tar-like substance was seen on the wick throughout the test period.

As described above, when the fuel gasifying portion of a wick composed of silica-alumina ceramic fibers is impregnated with a coating material consisting principally of an inorganic pigment, silicic anhydride and a surface active agent, said fuel gasifying portion becomes highly resistant to deposition of tar-like substance even when kerosene containing heavy components is used as liquid fuel, and there occurs no sharp drop of fuel gasifying rate for a long time in use, and hence there takes place no large variation of the air/fuel ratio in the combustion zone where the gasified fuel from the fuel gasifying portion is burned, thus allowing long-lasting stabilized combustion.

The present invention is not limited to the above-described structure but may be embodied in various other forms. For instance, the above-described effect of this invention is not impaired when using a flame-spreading auxiliary wick on the inside or outside or at the top end of the fuel gasifying portion. Also, although a cylindrical fuel gasifying portion was used in the embodiments described above, the same effect can be obtained by shaping said gasifying portion into a plate.

What is claimed is:

1. A combustion wick comprising a fuel suck-up portion where liquid fuel is sucked up and a fuel gasifying portion provided above said fuel suck-up portion, wherein of said fuel suck-up and fuel gasifying portions, at least the fuel gasifying portion is formed from silica-alumina type ceramic fibers with an organic binder, with at least a part of said portion being impregnated with a coating material composed principally of an inorganic pigment, silicic anhydride and a surface active agent.

2. The combustion wick according to claim 1, wherein the ceramic fibers in said coating material-impregnated portion are impregnated with a coating material to a pickup of 10 to 150 mg/cm$^3$ of said fibers.

3. The combustion wick according to claim 1, wherein the coating material is impregnated in a greater amount in the surface of the gasifying portion than in the inside thereof.

4. The combustion wick according to claim 1, wherein the amount of the surface active agent in the coating material is 0.2 to 5% by weight.

5. The combustion wick according to claim 1, wherein the capillaries in most of the coating material-impregnated portion are of a bore within the range of 1 to 10μ.

6. The combustion wick according to claim 1, wherein the fuel gasifying portion is formed cylindrical.

7. The combustion wick according to claim 1, wherein the fuel gasifying portion is formed plate-like.

* * * * *